US007358834B1

(12) United States Patent
Pepper et al.

(10) Patent No.: US 7,358,834 B1
(45) Date of Patent: Apr. 15, 2008

(54) TRANSMISSION LINE VOLTAGE CONTROLLED NONLINEAR SIGNAL PROCESSORS

(75) Inventors: Steven H. Pepper, Portland, OR (US); R. Clayton Smith, Boulder, CO (US); Ronald L. Ramsey, Boulder, CO (US); James R. Andrews, Boulder, CO (US)

(73) Assignee: Picosecond Pulse Labs, Boulder, CO (US)

( * ) Notice: Subject to any disclaimer, the term of this patent is extended or adjusted under 35 U.S.C. 154(b) by 629 days.

(21) Appl. No.: 10/233,290

(22) Filed: Aug. 29, 2002

(51) Int. Cl.
*H01P 1/20* (2006.01)

(52) U.S. Cl. ..... 333/208; 333/209

(58) Field of Classification Search ..... 333/17.1, 333/17.2, 20, 247, 248, 164, 156, 157, 17.21, 333/161, 208, 209, 115–117, 175, 177
See application file for complete search history.

(56) References Cited

U.S. PATENT DOCUMENTS

| | | | |
|---|---|---|---|
| 3,278,763 | A | 10/1966 | Grove |
| 3,629,731 | A | 12/1971 | Frye |
| 3,760,283 | A | 9/1973 | Lockwood |
| 3,768,025 | A | 10/1973 | Hreha |
| 3,909,751 | A | 9/1975 | Tang et al. |
| 4,051,450 | A | 9/1977 | Barlow |
| 4,075,650 | A | 2/1978 | Calviello |
| 4,473,807 | A | 9/1984 | Weber et al. |
| 4,487,999 | A | 12/1984 | Baird et al. |
| 4,594,557 | A | 6/1986 | Shillady |
| 4,654,600 | A | 3/1987 | Lockwood |
| 4,745,445 | A | 5/1988 | Mun et al. |
| 4,750,666 | A | 6/1988 | Neugebauer et al. |
| 4,855,696 | A | 8/1989 | Tan et al. |
| 4,910,458 | A | 3/1990 | Forsyth et al. |
| 4,956,568 | A | 9/1990 | Su et al. |
| 5,014,018 | A | 5/1991 | Rodwell et al. |
| 5,014,023 | A * | 5/1991 | Mantele ..... 333/164 |

(Continued)

FOREIGN PATENT DOCUMENTS

EP 0320175 A2 12/1988

(Continued)

OTHER PUBLICATIONS

Boivin et al., "Receiver Sensitivity Improvement by Impulsive Coding," *IEEE Photonics Technology Letters* 9:684-686 (May 1997).

(Continued)

*Primary Examiner*—Linh Nguyen
(74) *Attorney, Agent, or Firm*—Klarquist Sparkman, LLP

(57) ABSTRACT

Waveguide nonlinear signal processors include transmission lines defined on a substrate. A plurality of varactors or pairs of varactors are situated along the transmission line and are in communication with a signal conductor of the transmission line and one or more control conductors. A processor controller is configured to provide a control signal to the one or more control conductors to select operational characteristics of the varactors or pairs of varactors. In some examples, the varactors are diodes and a control signal is provided to select a diode current-voltage characteristic in order to limit or clip an input signal to positive and/or negative amplitudes. Alternatively, a control signal is configured to provide a selected spectral transmission bandwidth or propagation delay by selecting a varactor capacitance-voltage characteristic.

25 Claims, 8 Drawing Sheets

U.S. PATENT DOCUMENTS

| | | | | |
|---|---|---|---|---|
| 5,105,536 | A | 4/1992 | Neugebauer et al. | |
| 5,157,361 | A | 10/1992 | Gruchalla et al. | |
| 5,162,911 | A * | 11/1992 | Burrage | 348/723 |
| 5,256,996 | A * | 10/1993 | Marsland et al. | 333/20 |
| 5,267,200 | A | 11/1993 | Tobita | |
| 5,302,922 | A * | 4/1994 | Heidemann et al. | 333/18 |
| 5,378,939 | A * | 1/1995 | Marsland et al. | 327/91 |
| 5,444,564 | A * | 8/1995 | Newberg | 398/195 |
| 5,479,120 | A | 12/1995 | McEwan | |
| 5,506,513 | A | 4/1996 | Bacher | |
| 5,679,006 | A | 10/1997 | Madelaine | |
| 5,739,730 | A * | 4/1998 | Rotzoll | 331/177 V |
| 5,760,661 | A * | 6/1998 | Cohn | 333/164 |
| 5,789,994 | A * | 8/1998 | Case et al. | 333/20 |
| 5,917,387 | A * | 6/1999 | Rice et al. | 333/174 |
| 5,952,727 | A | 9/1999 | Takano et al. | |
| 5,956,568 | A | 9/1999 | Shiralagi et al. | |
| 6,060,915 | A | 5/2000 | McEwan | |
| 6,097,263 | A * | 8/2000 | Mueller et al. | 333/17.1 |
| 6,160,312 | A | 12/2000 | Raad | |
| 6,335,665 | B1 * | 1/2002 | Mendelsohn | 333/139 |
| 6,404,304 | B1 * | 6/2002 | Kwon et al. | 333/202 |
| 6,429,822 | B1 * | 8/2002 | Naudin et al. | 343/754 |
| 6,628,849 | B2 | 9/2003 | Yap et al. | |
| 6,670,928 | B1 * | 12/2003 | Chekroun et al. | 343/754 |
| 6,774,737 | B1 * | 8/2004 | Seely et al. | 331/177 V |
| 6,900,710 | B2 * | 5/2005 | Agoston et al. | 333/248 |
| 2002/0130734 | A1 * | 9/2002 | Liang et al. | 333/134 |
| 2002/0145484 | A1 * | 10/2002 | Agoston et al. | 333/20 |
| 2002/0167373 | A1 * | 11/2002 | Agoston et al. | 333/20 |
| 2003/0112186 | A1 * | 6/2003 | Sanchez et al. | 343/700 MS |
| 2005/0270091 | A1 | 12/2005 | Kozyrev et al. | |
| 2006/0125572 | A1 | 6/2006 | van der Weide et al. | |

FOREIGN PATENT DOCUMENTS

| | | |
|---|---|---|
| EP | 0453744 A1 | 3/1991 |
| EP | 0753890 A2 | 1/1997 |
| GB | 2280988 A * | 2/1995 |

OTHER PUBLICATIONS

R. Levy, "New Coaxial-to-Stripline Transformers Using Rectangular Lines," *IEEE Trans. Microwave Theory Tech.*, MTT-9:273-274 (May 1961).

W.M. Grove, "Sampling for Oscilloscopes and Other RF Systems: Dc Through X-Band," *IEEE Transactions on Microwave Theory and Techniques* MTT-14:629-635 (Dec. 1966).

Merkelo et al., "Broad-Band Thin-Film Signal Sampler," *IEEE I. of Solid-State Circuits* SC-7:50-54 (Feb. 1972).

Pullela et al., "Multiplexer/Demultiplexer IC Technology for 100 Gb/s Fiber-Optic Transmission," *IEEE I. of Solid State Circuits* (Mar. 1996).

Whiteley et al., "50 GHz Sampler Hybrid Utilizing a Small Shockline and an Internal SRD," *IEEE MTT-S Digest* AA-6:895-898 (1991).

S. Allen, "Schottky Diode Integrated Circuits for Sub-Millimeter-Wave Applications," University of California (Jun. 28, 1994).

M. Case, "Nonlinear Transmission Lines for Picosecond Pulse, Impulse and Millmeter-Wave Harmonic Generation," University of California (Jul. 2, 1993).

S.T. Allen et al., "72 GHz Sampling Circuits Integrated with Nonlinear Transmission Lines," IEEE Device Research Conference (1994).

M. Rodwell, "GaAs Nonlinear Transmission Lines for Picosecond Pulse Generation and Millimeter-Wave Sampling," *IEEE Trans. Microwave Theory Tech.*, 7:1194-1204 (Jul. 1991).

* cited by examiner

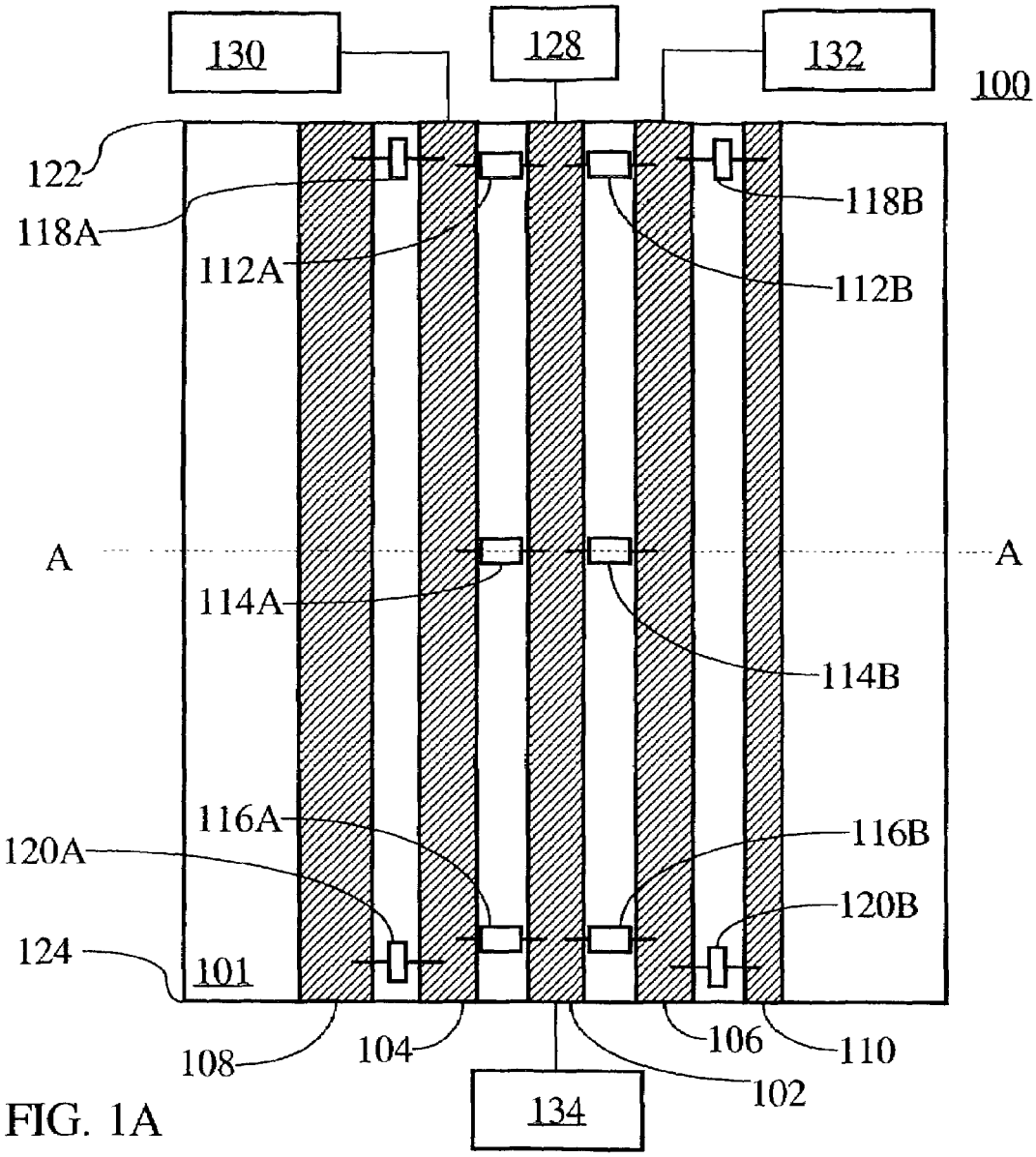
FIG. 1A
FIG. 1B
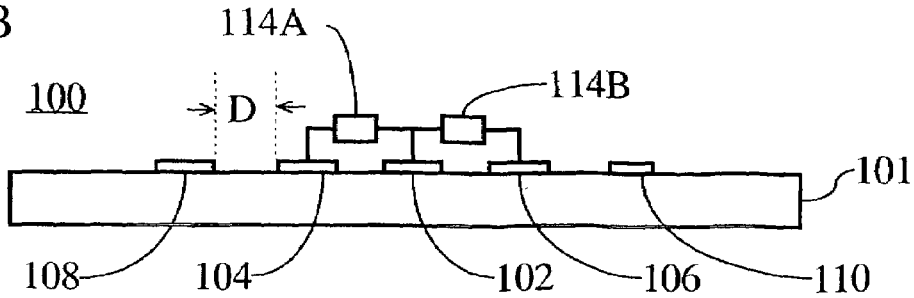

TRANSMISSION LINE VOLTAGE CONTROLLED NONLINEAR SIGNAL PROCESSORS

TECHNICAL FIELD

The disclosure pertains to nonlinear transmission line signal processors.

BACKGROUND

High bit-rate data signals are typically processed prior to data extraction in order to improve data recovery accuracy. While data signals can be processed to remove some types of signal defects, such processing tends to be difficult for data signals at data rates greater than a few Gb/s. In addition, signal processing circuits used to improve apparent signal quality frequently introduce new signal defects. For example, data recovery operations for signals based on the Synchronous Optical Network (SONET) frequently use so-called Gaussian or Bessel-Thompson low pass filters to limit data signal bandwidth. Unfortunately, these filters are typically reflective filters that reject high frequency components by reflection while transmitting other frequency components. The reflected frequency components can produce undesirable signal artifacts so that such filters are used with attenuators that generally attenuate all frequency components. As a result of such filtering, undesirable high frequency signal components are removed but with an overall reduction in signal level.

Establishing a preferred filter configuration for a particular data transmitter or receiver generally involves a test procedure using several filters. Based on signal quality measurements associated with these filters, a preferred filter configuration is selected and implemented. This procedure can be expensive and time consuming. In addition, measurements based on a few filters may be inadequate to identify a filter configuration that produces optimum data quality. Changes in signal source, receiver characteristics, or transmission path can be compensated only by repeating the test procedure.

Limiters or clippers are also used with high frequency electrical signals such as high bit-rate data signals. These limiters and clippers are generally based on diodes that are configured to limit signal amplitude. Unfortunately, the capacitance associated with limiter/clippers diodes degrades limiter/clipper performance, especially at high frequencies.

In view of these and other shortcomings, improved signal processing apparatus and methods are needed.

SUMMARY

For convenience, as used herein, a varactor is a circuit element having a non-linear current-voltage characteristic, or a voltage or current selectable resistance, capacitance, or inductance, or a similar circuit element.

Waveguide nonlinear signal processors include a waveguide having a signal conductor configured to communicate an electrical signal from an input to an output. At least two varactors are distributed along the signal conductor and are configured to electrically connect the signal conductor and at least one control conductor. The control conductor has a control input configured to receive a control signal. According to representative examples, the varactors are Schottky diodes or other diodes configured to exhibit a diode current-voltage characteristic, a diode capacitance-voltage characteristic, or provide a selected phase delay or spectrally filter the electrical signal applied to the signal conductor. In other examples, the signal processors include a processor controller in communication with the at least one control conductor and configured to select a varactor characteristic. According to some examples, the controller is configured to select a diode current-voltage characteristic or a diode capacitance-voltage characteristic.

Balanced transmission line signal processors include a transmission line signal conductor, a first control conductor, and a second control conductor. At least two pairs of varactors are distributed along the transmission line signal conductor. The varactor pairs include first and second varactors that are in communication with the transmission line signal conductor and the first and second control conductors, respectively. According to representative examples, the varactors are diodes and a processor controller is provided that is configured to select a diode operating characteristic. In additional examples, the first and second varactors are similar.

Signal processors include waveguide means and varactor means distributed along and in electrical communication with the waveguide means. A processor control means is in electrical communication with the varactor means and is configured to select a varactor means characteristic.

Tunable limiters include a waveguide and at least two varactors situated along and in electrical communication with the waveguide. At least one control conductor is configured to deliver a control signal to the at least two varactors, wherein the control signal is associated with a limiting signal amplitude. According to representative examples, the tunable limiters include a semiconductor substrate that supports at least a portion of the waveguide and the varactors are defined on the semiconductor substrate.

Balanced tunable limiters include a waveguide and at least two varactor pairs situated along and in electrical communication with the waveguide. At least one control conductor is configured to deliver a control signal to the varactor pairs, wherein the control signal is associated with a selected positive signal limiting amplitude and/or a selected negative signal limiting amplitude.

Voltage controlled signal limiters include a transmission line and a plurality of nonlinear shunt elements distributed along the transmission line. At least one control conductor is configured to select an operational characteristic of the plurality of nonlinear shunt elements. According to representative examples, the operational characteristic is a current-voltage characteristic.

Voltage controlled signal processors include an input waveguide section, an output waveguide section, and a processing waveguide section. The processing waveguide section includes a plurality of diode sections distributed along an axis of the processing waveguide section. In some examples, at least one of the diode sections includes at least two diodes distributed along the axis or arranged symmetrically with respect to the axis. According to representative examples, the voltage controlled signal limiters include a first diode section nearest the input waveguide and having a first diode in series with a first resistor and configured to connect a signal conductor to a first control conductor. A second diode in series with a second resistor is configured to electrically connect a second control conductor to the signal conductor. In additional examples, the voltage controlled signal processors include a controller configured to provide control signals to the first and second control conductors so that the diodes are reverse biased. In additional examples, the controller is configured to provide control signals to the first and second control conductors so that the diodes are forward biased. In additional examples, the diodes are configured to exhibit a diode current-voltage or capacitance voltage characteristic, or are configured based on a selected delay or to provide spectral filtering.

Tunable delay lines include a transmission line and at least two varactors distributed along an axis of the transmission line. A control conductor is provided to direct a control signal to at least one of the two varactors to select a propagation delay.

Signal detectors comprise a waveguide having a signal conductor configured to receive an input electrical signal. At least two varactors are distributed along the waveguide and a control conductor is configured to receive an electrical signal associated with at least a portion of the input signal. In some examples, the varactors are configured so that the electrical signal received by the control conductor is associated with an amplitude of the input electrical signal. Signal processing systems include such signal detectors and a controller configured to provide a control signal to the varactors based on the electrical signal received by the control conductor.

Communication systems include a data transmitter that produces a data signal and a tunable signal processor that is configured to receive and process the data signal. A processor controller provides a control signal to the tunable signal processor and a data receiver is configured to receive the processed data signal. According to representative examples, the tunable signal processor includes a nonlinear transmission line and a plurality of varactors.

Signal processing methods include directing an electrical signal along a transmission line and distributing a plurality of varactors along the transmission line. The varactors are controlled based on a selected signal processing characteristic. According to representative examples, the varactors are controlled to provide a voltage-capacitance characteristic selected to spectrally filter the electrical signal or adjust phase or delay. In other examples, the varactors are controlled to provide a current-voltage characteristic selected to limit the electrical signal.

Communication methods include directing a data signal to propagate along a tunable transmission line and directing the data signal from the tunable transmission line to a signal measurement system. The transmission line is tuned to modify signal quality based on signal quality measurements from the signal measurement system. According to representative examples, the transmission line is tuned to limit data signal magnitude. In additional examples, the transmission line is tuned to spectrally filter the data signal.

Signal processing methods include directing an electrical signal to a transmission line having distributed processing elements and configuring the processing elements to absorb a selected portion of the electrical signal. According to representative examples, the processing elements are configured to absorb selected spectral components and/or select a phase or a delay. In other examples, the processing elements are configured to absorb signal portions having amplitudes greater than a selected signal amplitude.

These and other features and aspects are set forth below with reference to the accompanying drawings.

BRIEF DESCRIPTION OF THE DRAWINGS

FIG. 1A is a schematic plan view of a nonlinear transmission line that includes a plurality of varactors such as Schottky diodes.

FIG. 1B is a schematic sectional view of the transmission line of FIG. 1A.

DETAILED DESCRIPTION

Figure 1C:
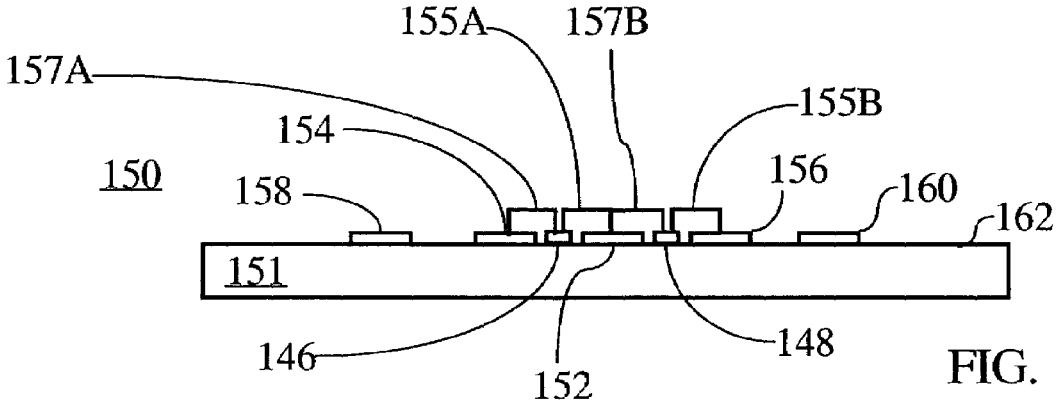
FIG. 1C is a schematic sectional view of a transmission line that includes Schottky diodes formed on a gallium arsenide substrate.

As used herein, a varactor is a circuit element having a non-linear current/voltage characteristic, and/or a voltage or current variable capacitance, inductance, or resistance. Representative examples of varactors include diodes, varactor diodes, and micromechanical capacitors. As used herein, a limiter or clipper is a circuit assembly that is configured to constrain an amplitude of an electrical signal. For example, a limiter can constrain electrical signal voltage to be within a predetermined voltage range or an electrical signal current to be within a predetermined current range.

With reference to FIGS. 1A-1B, a nonlinear transmission line (NLTL) signal processor 100 includes a signal conductor 102, control conductors 104, 106, and reference conductors 108, 110. Varactor pairs 112A, 112B, 114A, 114B, and 116A, 116B are configured to electrically connect the control conductors 104, 106 to the signal conductor 102. The processor 100 is conveniently formed on a substrate 101 such as a semiconductor, a non-conductor, or other type of substrate. If the processor 100 includes a semiconductor substrate of, for example, gallium arsenide, silicon, germanium, indium gallium arsenide, or other semiconductor, the varactor pairs can be formed using the substrate. Alternatively, discrete varactors can be used. As shown in FIGS. 1A-1B, the varactors are discrete components that are electrically connected to conductors 102, 104, 106.

Processor controllers 130, 132 are in communication with the control conductors 104, 106, respectively, and can be configured to provide predetermined constant voltages, time varying voltages, or other control signals such as current-based control signals. Such voltages and currents are referred to herein as control signals. A signal source 128 is situated to deliver an electrical signal to the signal conductor 102, and a receiver 134 is configured to receive a processed electrical signal from the processor 100.

The processor 100 includes capacitors 118A, 118B and 120A, 120B that are conveniently located in proximity to processor interface ends 122, 124, respectively, and electrically connect the control conductors 104, 106 to the respective reference conductors 108, 110. The control conductors 104, 106 are separated from the respective reference conductors 108, 110 by a distance D that can be selected to, for example, provide a predetermined capacitance. In some examples, the reference conductors 108, 110 can be configured to overlap vertically. As shown in FIGS. 1A-1B, the conductors 102, 104, 106, 108, 110 are equally spaced, but in other examples the conductors can have equal or unequal separations.

FIG. 1C is a sectional view of a processor 150 that includes a signal conductor 152, control conductors 154, 156, and reference conductors 158, 160 that are situated on a surface 162 of a gallium arsenide substrate 151. Schottky diodes 146, 148 are formed with the gallium arsenide substrate 151 and electrically connect the signal conductor 152 and the control conductors 154, 156, respectively, with airbridges 155A, 155B and 157A, 157B. The processor 150 includes additional Schottky diode pairs (typically two or more pairs) but these are not shown in the sectional view of FIG. 1C.

Control signals can be provided to the control conductors 154, 156 to forward bias, reverse bias, or otherwise control the Schottky diodes 146, 148. Forward biased diodes are generally associated with clipping an input signal voltage based on the forward bias diode current-voltage characteristic. With such a configuration of control voltages, the processor 150 tends to reduce or "clip" larger amplitude portions of input data signals. The diodes 146, 148 can be configured to clip positive and/or negative portions of an input data signal, and clipping characteristics can be set by adjusting the control signals applied to the control conductors 154, 156.

The control conductors 154, 156 can also receive control signals configured to reverse bias the diodes 146, 148. Reverse biased diodes can be associated with a capacitance-voltage (CV) characteristic so that the diodes 146, 148 provide tunable, signal level dependent capacitances. Selection of control conductor voltages can be configured to provide distributed filtering in which selected signal components are removed from an input data signal. Such signal components are substantially absorbed by the diodes 146, 148, and signal reflection is substantially reduced. Alternatively, the diodes can be configured to provide a selected phase or delay.

Signal portions can be absorbed by diode series resistance, or additional resistors can be provided. Diode resistance and/or resistance of additional resistors can be determined using computer simulations. Other parameters can also be determined using computer simulation. Generally transmission line configurations are selected so that varactor capacitance is larger than transmission line distributed capacitance. Typically, a transmission line is selected having a relatively high impedance, and varactors are selected so that a resulting loaded transmission line impedance corresponds to or approaches an intended value.

Figure 1D:
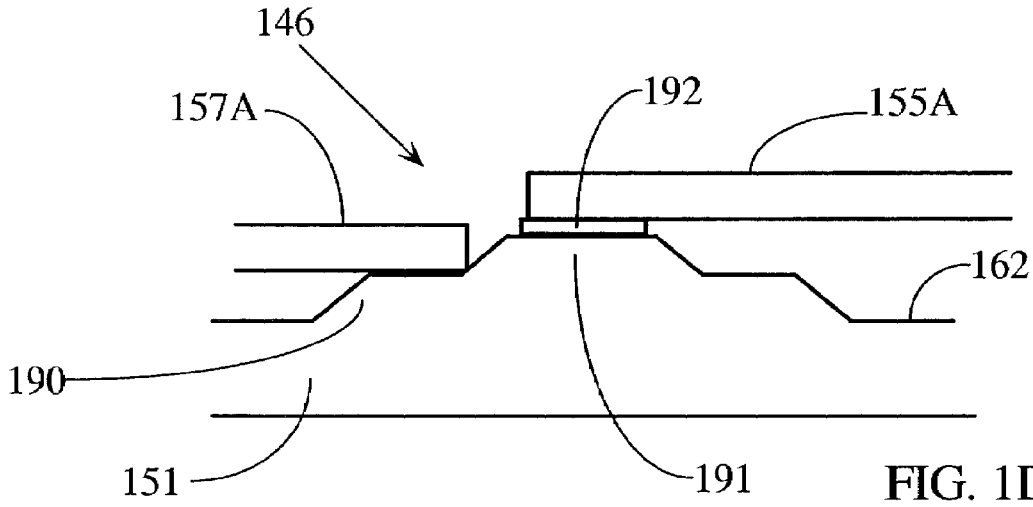
FIG. 1D is a partial sectional view of the transmission line of FIG. 1C illustrating a representative Schottky diode.

Referring to FIG. 1D, the diode 146 is defined on the substrate 151 by an N+ layer 190, an N− layer 191, and a Schottky metal layer 192. The N+ layer 190 and the N− layer 191 are approximately 1.5 μm thick and 0.4 μm thick, respectively. The Schottky metal layer 192 is approximately a square having a side of length of about 2 μm. Portions of the airbridges 155A, 157A are electrically connected to the diode 146 and extend from the diode 146 above the surface 162 of the substrate 151 at a distance of from about 0.5 μm to about 4 μm.

Figure 2:
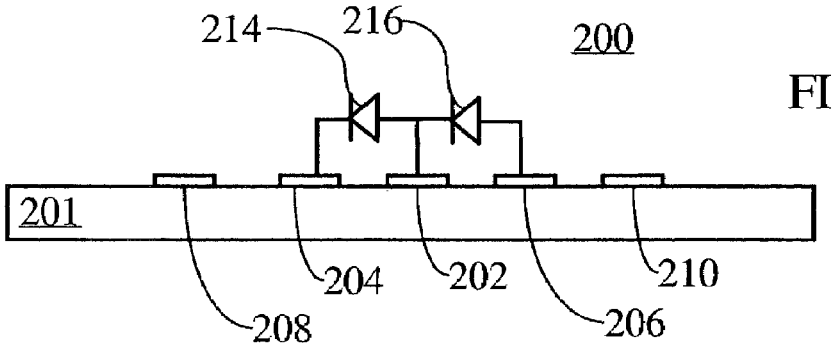
FIG. 2 is a schematic sectional view of a nonlinear transmission line filter that includes discrete Schottky diodes.

With reference to FIG. 2, a nonlinear transmission line processor 200 includes a signal conductor 202, control conductors 204, 206, and reference conductors 208, 210 situated on a substrate 201. Discrete Schottky diodes 214, 216 or other varactors are configured to electrically connect the signal conductor 202 to the control conductors 204, 206. The processor 200 includes additional diodes or other varactors, typical four or more diodes, that are not shown in the sectional view of FIG. 2. The diodes 214, 216 can be soldered or otherwise electrically connected to the conductors 202, 204, 206.

Figure 3:
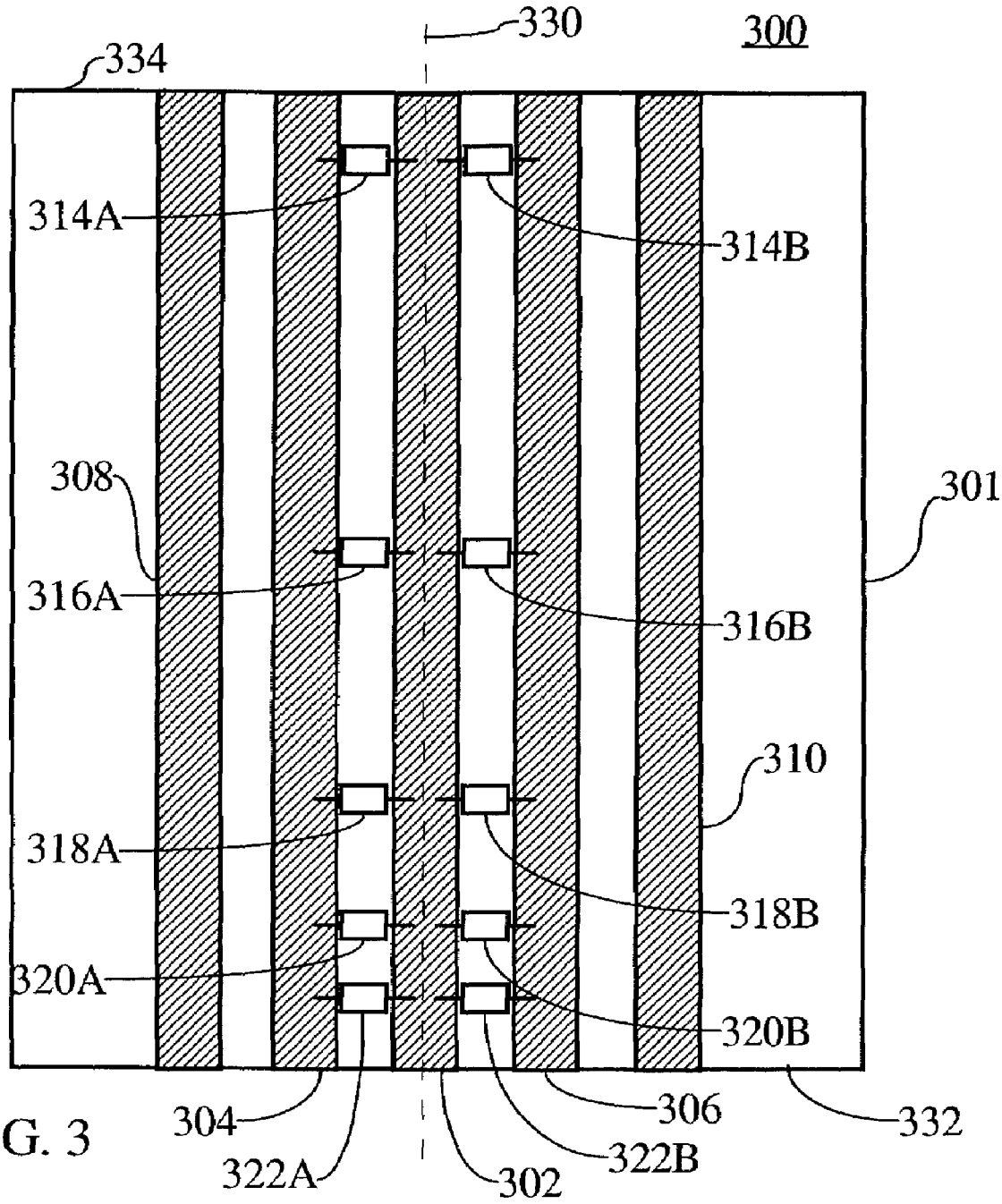
FIG. 3 is a schematic plan view of a nonlinear transmission line signal processor that includes unevenly spaced varactors.

With reference to FIG. 3, a nonlinear transmission line processor 300 includes conductors 302, 304, 306, 308, 310 situated on a substrate 301. The processor 300 includes varactor pairs 314A, 314B, 316A, 316B, 318A, 318B, and 320A, 320B that are distributed with diminishing separations along an axis 330 from a first interface end 332 to a second interface end 334. In other examples, varactor pairs of different sizes can be selected to, for example, provide increased current handling capacity for varactors that provide substantial processing. In some examples, varactors situated at or near a signal input are configured to provide larger current handling capacity than varactors situated closer to a signal output.

Figure 4A:
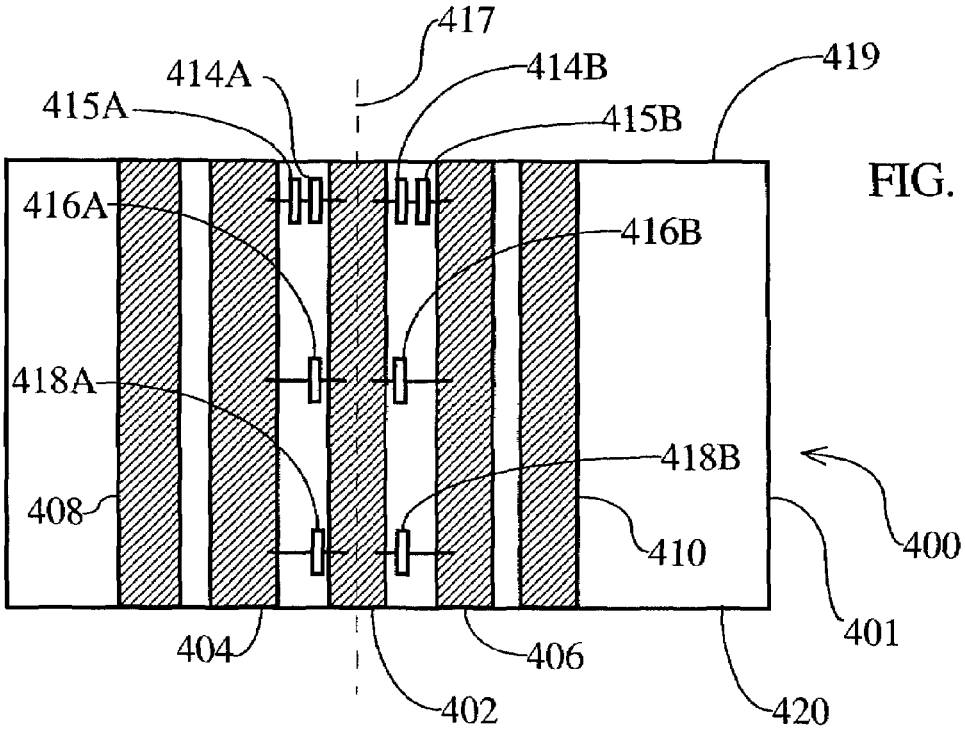
FIG. 4A is a schematic block diagram of a nonlinear processor.

With reference to FIG. 4A, a nonlinear transmission line processor 400 includes conductors 402, 404, 406, 408, 410 situated on a substrate 401. The processor 400 includes varactor pairs 414A, 414B, 416A, 416B, and 418A, 418B that electrically connect the conductors 402, 404, 406. The varactors 414A, 414B are associated with respective resistors 415A, 415B. Additional resistors can be provided for the remaining varactors and typically resistors are provided for the varactors that are configured to produce significant signal processing and/or receive significant electrical power, voltage, or currents based on the properties of the selected varactors. Varactor pairs can be distributed with diminishing separations along an axis 417 from an input end 419 to an output end 420. In other examples, varactor pairs of different sizes can be selected to, for example, provide increased current handling capacity for varactors that provide substantial processing. In some examples, varactors that provide initial processing of an input data signal are associated with resistors and such resistors are unnecessary in subsequent processing. In other examples, resistors can be configured to absorb unwanted spectral components.

Figure 4B:
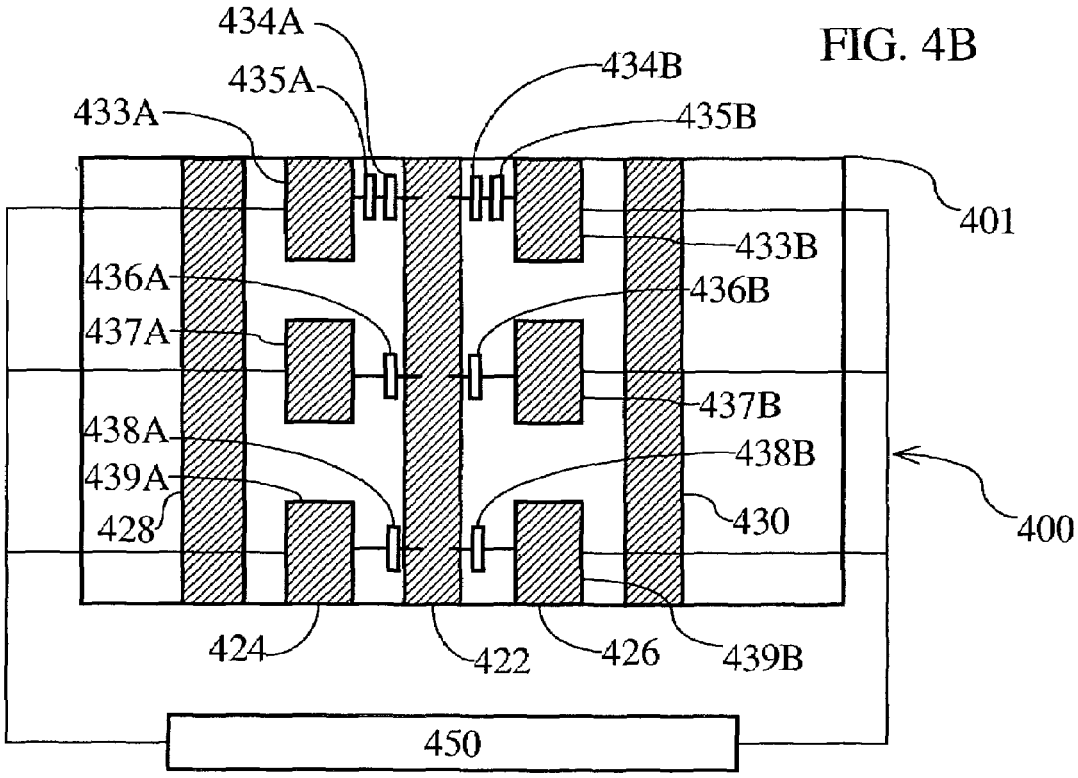
FIG. 4B is a schematic block diagram of a nonlinear processor that includes control conductor segments.

FIG. 4B is a schematic plan view of a nonlinear processor that includes a signal conductor 422, control conductors segments 433A, 433B, 437A, 437B, 439A, 439B, and reference conductors 428, 430. Varactors 434A, 436A, 438A are in electrical communication with respective control conductor segments 433A, 437A, 439A and varactors 434B, 436B, 438B are in electrical communication with respective control conductor segments 433B, 437B, 439B. A controller 450 is configured to provide independent control signals so that some varactors can be tuned for clipping, filtering, or otherwise independently configured.

Figure 5:
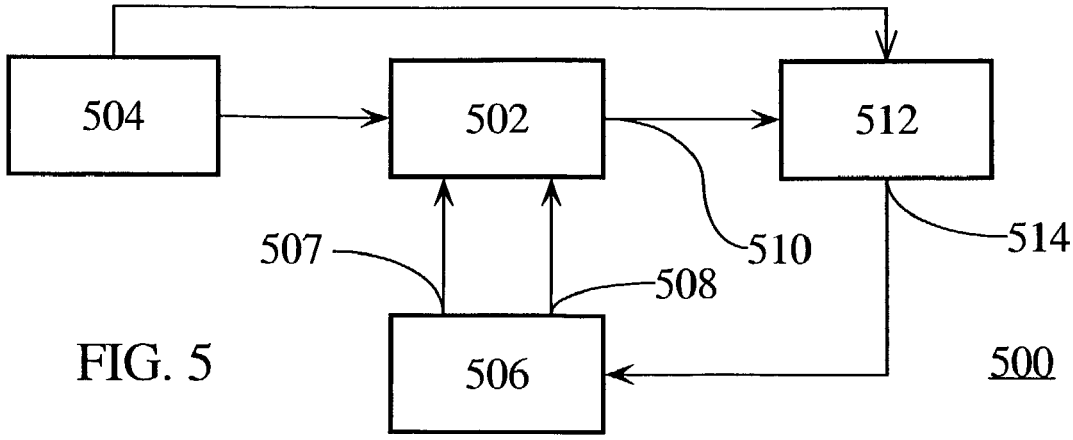
FIG. 5 is a schematic block diagram of a communication test system.

FIG. 5 is a block diagram of a communication test system 500 that includes a nonlinear signal processor 502 that receives a data signal from a data source 504. A processor controller 506 includes control outputs 507, 508 that are configured to provide one or more control voltages or other control signals to the processor 502. The control signals can include low frequency or high frequency signal components and in some cases, substantially constant voltages are applied as control signals. The processor 502 includes an output 510 that is configured to deliver a processed data signal to a data processing system 512 such as a data recovery system or a data analysis system. Representative data processing systems include a signal analysis system configured to display or analyze eye patterns or a data recovery system configured to recover digital data from the processed data signal. For example, the data source 504 and the data processing system 512 can be associated with a bit error rate test (BERT) system, and the data source 504 configured to generate pseudorandom data. The processor controller 506 is configured to provide control signals based on data quality indicator provided by the data processing system 512 from an indicator output 514. The control signals can be selected based on a predetermined bit error rate, eye diagram opening, or other data quality indicator.

Data signals produced by signal sources generally include undesired components such as signal portions associated with overshoot, undershoot, ringing, droop, amplitude noise, or other signal defects. In addition, amplification, buffering, or other processing of data signals can introduce additional signal imperfections. A nonlinear processor such as the processor 502 can be configured to compensate, correct, filter, or substantially reduce such signal defects. For example, control signals provided by the processor controller 506 can be selected to at least partially forward bias diodes that connect the signal conductor and control conductors, respectively. The control signals can be selected so that a data signal is processed so that the associated processed data signal is limited to a predetermined amplitude range, typically a predetermined voltage range. Signal processing can be configured based on a preferred voltage range for subsequent data processing/data recovery systems. If used in a test system such as that of FIG. 5, preferred control signals can be identified based on a recovered or otherwise analysed processed data signal, and a suitable nonlinear processor can be configured for an operational system. In an operational system, a nonlinear processor can be provided with variable control signals, or control signals can be fixed.

The processor 502 can also be controlled to filter a data signal. Filtering can be tuned to remove selected signal portions such as selected frequency components based on a predetermined filter bandwidth or filter spectrum, or to achieve a predetermined signal quality, eye opening, or bit error rate. Based on filter properties obtained by tuning the nonlinear processor 502, a fixed filter can be selected for a particular application. Alternatively, such control conductor voltages can be established so the tunable waveguide filter is appropriately tuned for use in operational equipment.

Figure 6A:
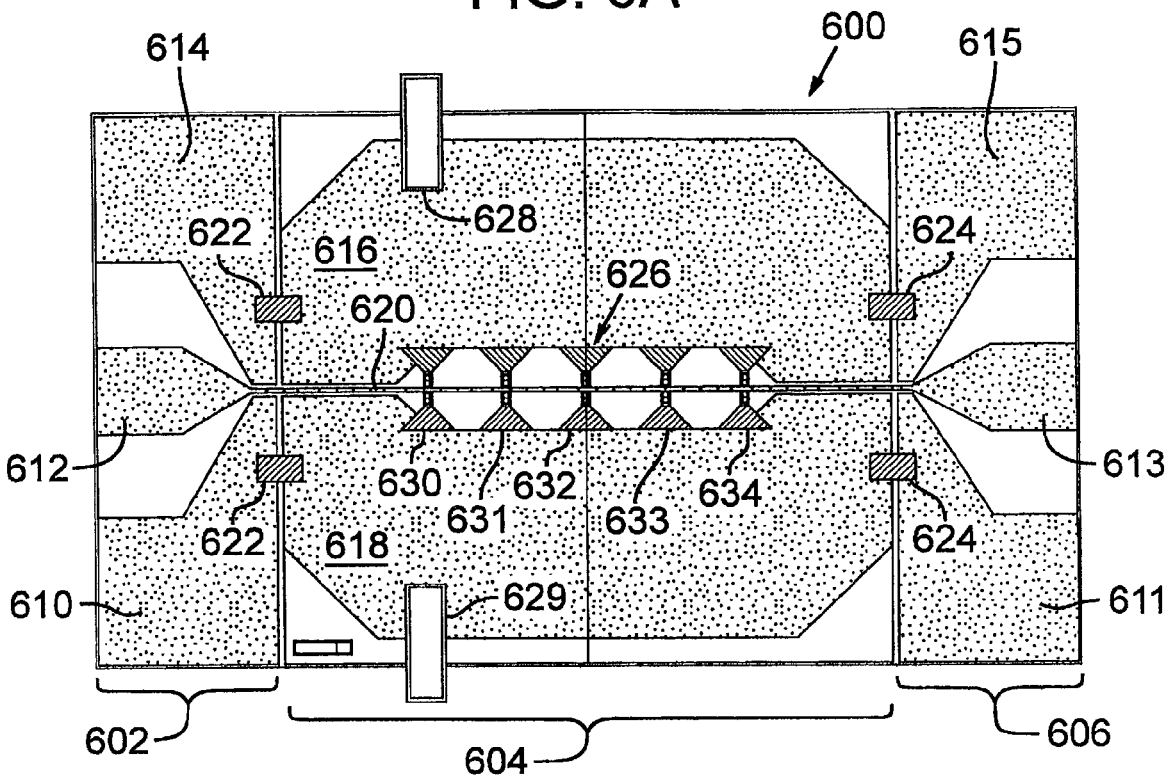
FIGS. 6A-6B are schematic diagrams of a voltage controlled filter that includes a nonlinear transmission line.
Figure 6B:
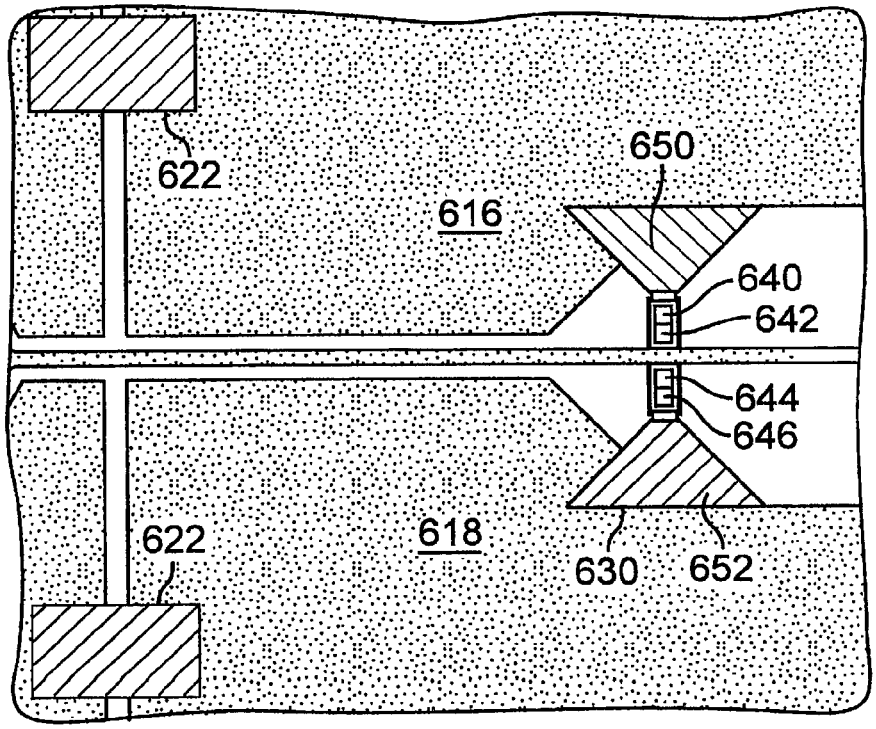

With reference to FIGS. 6A-6B, a voltage controlled filter 600 configured for use at, for example, frequencies between about 25 GHz and 36 GHz includes interface waveguide sections 602, 606 and a processing section 604. The interface waveguide sections 602, 606 include conductor sections 610, 612, 614 and 611, 613, 615, respectively, that are configured as coplanar waveguides. The processing section 604 includes conductors 616, 618, 620 that are configured as a coplanar waveguide. In other examples, interface sections and/or processing sections can include stripline, slotline, or other waveguide configurations, and such waveguides can include conductors with fixed or variable spacings. The processing section 604 also includes DC block portions 622, 624 and a nonlinear transmission line (NLTL) 626. Conductors 628, 629 are in communication with the conductors 616, 618, respectively and can be configured to deliver one or more control voltages to the processing section 604. Locations of the DC block portions 622, 624 can be variously selected. Additional capacitances that are not shown in FIGS. 6A-6B can also contribute to DC blocking.

The NLTL 626 includes diode sections 630, 631, 632, 633, 634. The diode section 631 is illustrated in greater detail in FIG. 6B. Diodes (typically Schottky diodes) 640, 646 and resistors 642, 644 are configured to electrically connect the conductors 616, 618 to the conductor 620. Typically the conductors 616, 618, 620 are defined on a surface of a planar substrate such as a gallium arsenide substrate and airbridge conductors 650, 652 extend from the conductors 616, 618 to the diodes 640, 646, respectively.

Figure 7A:
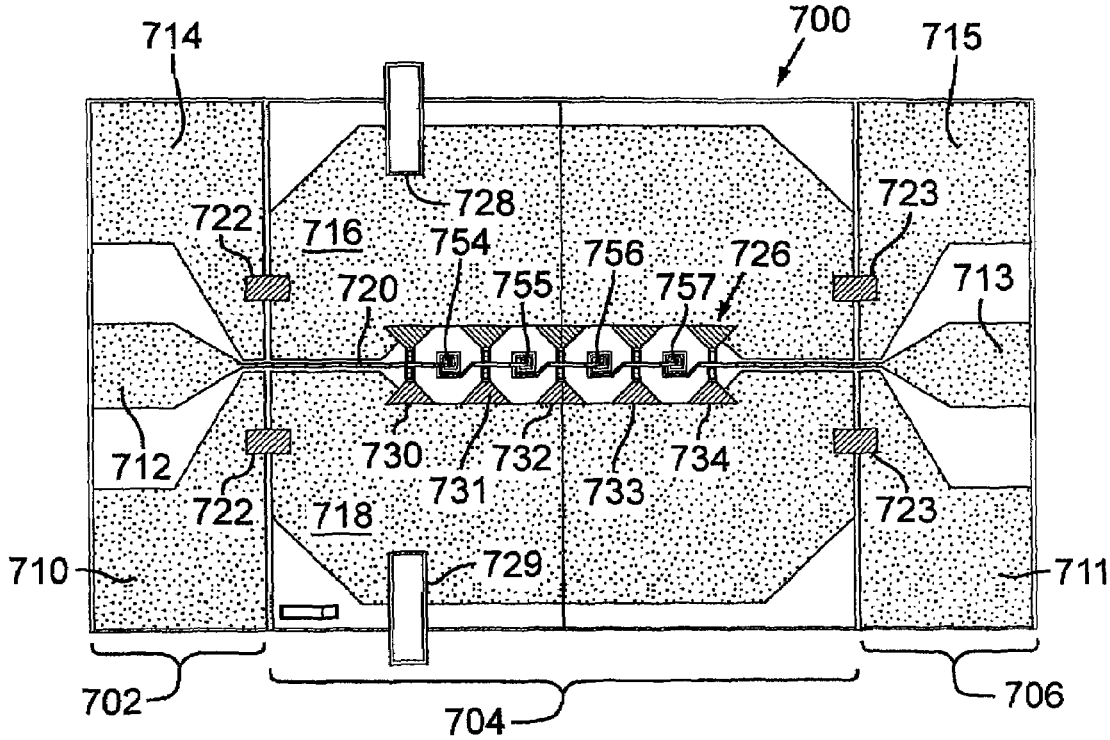
FIGS. 7A-7B are schematic diagrams of a voltage controlled filter that includes a nonlinear transmission line.
Figure 7B:
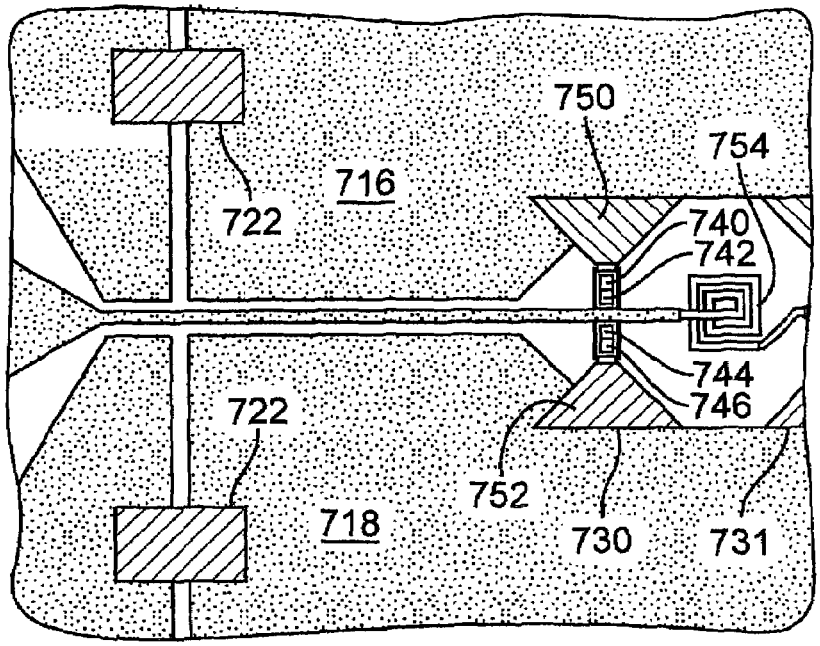

With reference to FIGS. 7A-7B, a voltage controlled filter 700 configured for use at, for example, frequencies between about 7 GHz and 13 GHz includes interface waveguide sections 702, 706 and a processing section 704. The interface waveguide sections 702, 704 include conductors 710, 712, 714 and 711, 713, 715, respectively, that are configured as coplanar waveguides. The processing section 704 includes conductors 716, 718, 720 that are configured as a coplanar waveguide. The processing section 704 also includes DC block portions 722, 723 and a nonlinear transmission line section 726. Conductors 728, 729 are in communication with the conductors 716, 718, respectively and can be configured to deliver one or more control voltages to the processing section 704.

The NLTL section 726 includes diodes sections 730-734 and inductors 754, 755, 756, 757 situated along the conductor 720. Referring to FIG. 7B, the diode section 730 includes diodes (typically Schottky diodes) 740, 746 and resistors 742, 744 that are configured to electrically connect the conductors 716, 718 to the conductor 720. Typically the conductors 716, 718, 720 are defined on a surface of a planar substrate and airbridge conductors 750, 752 extend from the conductors 716, 718 to the diodes 740, 746, respectively.

Figure 8A:
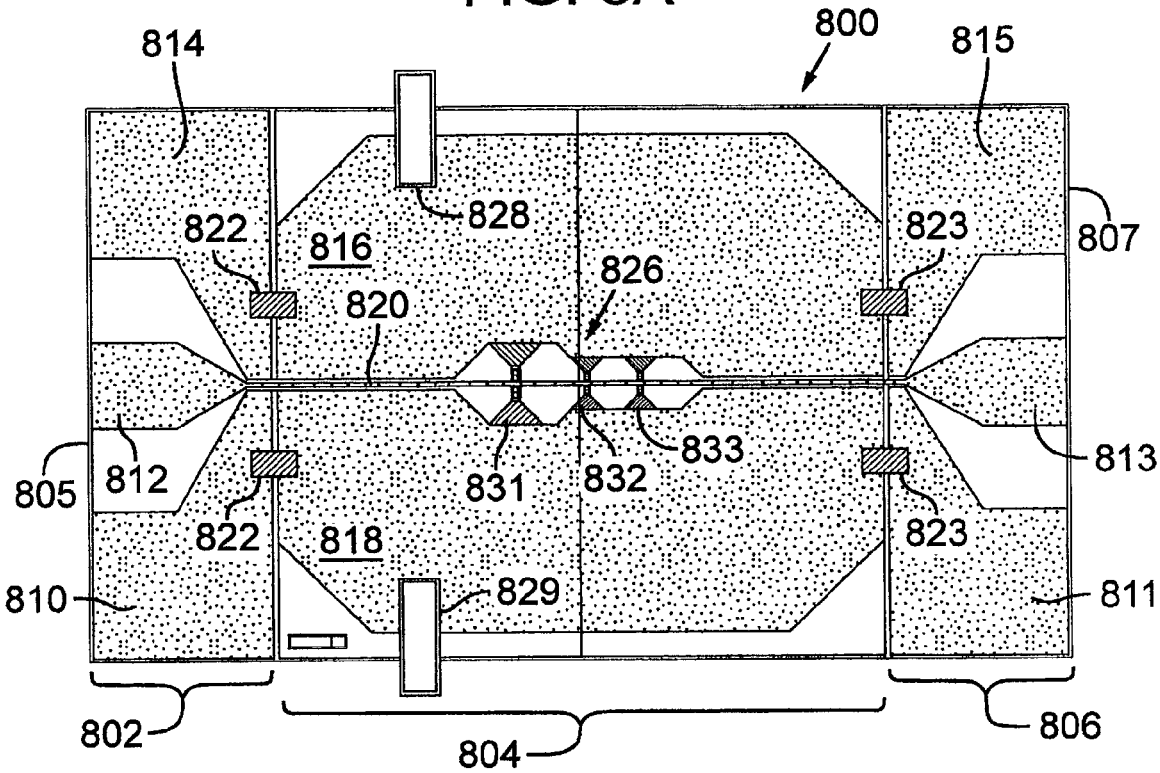
FIGS. 8A-8B are schematic diagrams of a clipper that includes a nonlinear transmission line.
Figure 8B:
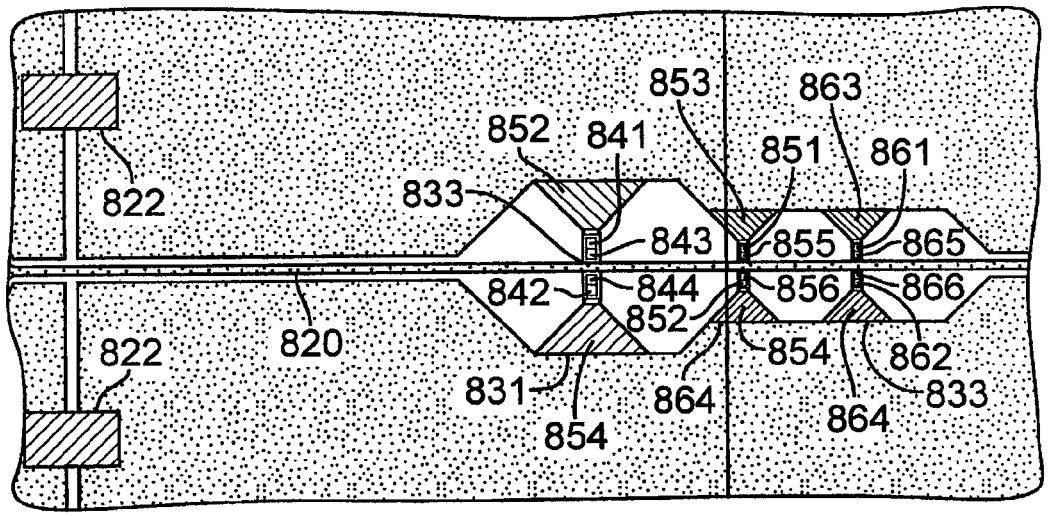

With reference to FIGS. 8A-8B, a clipper 800 configured for use at, for example, frequencies between about 10 GHz and 40 GHz includes interface waveguides sections 802, 806 and a processing section 804. The interface sections 802, 804 include conductor sections 810, 812, 814 and 811, 813, 815, respectively, that are configured as coplanar waveguides. The processing section 804 includes conductors 816, 818, 820 that are configured as a coplanar waveguide. Typically the conductors 816, 818, 820 are defined on a surface of a planar substrate. The processing section 804 also includes DC block portions 822, 823 and a nonlinear transmission line section 826. Conductors 828, 829 are in communication with the conductors 816, 818, respectively and can be configured to deliver one or more control voltages to the processing section 804. As shown in FIG. 8A, the clipper 800 includes a signal input end 805 and a signal output end 807.

The NLTL section 826 includes diodes sections 831-833. Referring to FIG. 8B, the diode section 831 includes Schottky diodes 841, 842 and resistors 843, 844 that are configured to electrically connect the conductors 816, 818 to the conductor 820. Airbridge conductors 852, 853 extend from the conductors 816, 818 to the diodes 841, 842, respectively. The NLTL section 826 also includes diodes sections 832, 833 that include Schottky diodes 851, 852 and 861, 862, respectively that electrically connect the conductor 820 to the conductors 816, 818. Airbridge sections 853, 863 electrically connect the conductor 816 to the diodes 851, 861, respectively, and airbridge sections 854, 864 electrically connect the conductor 818 to the diodes 852, 862, respectively. Additional airbridge conductors 855, 856, 865, 866 connect the diodes to the conductor 820.

Figure 9A:
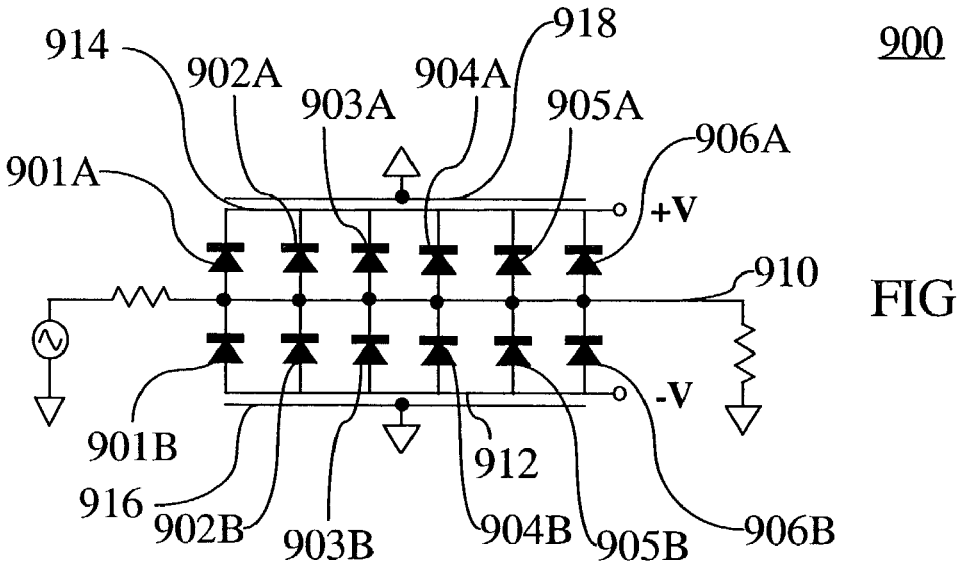
FIGS. 9A-9B are schematic diagrams of voltage controlled limiters/filters that include diodes distributed along a transmission line.

Referring to FIG. 9A, a distributed processor 900 includes diodes 901A-905A, 901B-905B that are distributed along a transmission line defined by outer conductors 912, 914 and an inner conductor 910. The processor also includes reference conductors 916, 918. Control voltages (+V, −V) are applied to the outer conductors 912, 914, respectively to establish bias conditions for the diodes 901A-905B. Bias conditions can be selected to, for example, produce a diode current-voltage characteristic in order to limit or clip an input signal to positive and/or negative amplitudes based on the control signals. Alternatively, control signals can be configured to provide a selected spectral transmission bandwidth and/or delay by selecting a diode capacitance-voltage characteristic.

Figure 9B:
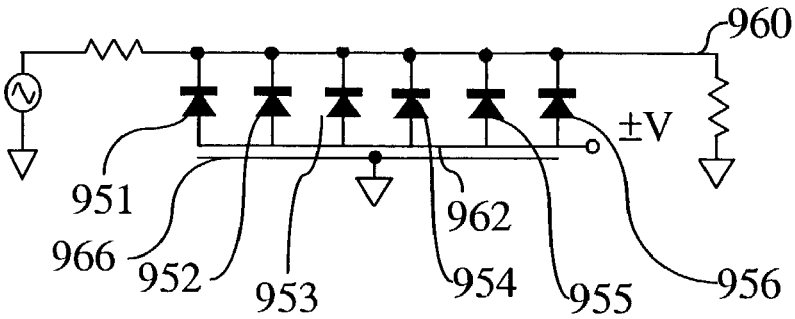

Referring to FIG. 9B, a distributed processor 950 includes diodes 951-956 that are distributed along a transmission line defined by conductors 960, 960. The processor 950 also includes a reference conductor 966. A control voltage (±V) applied to the conductor 962 establishes bias conditions for the diode 951-956. Bias conditions can be selected to, for example, produce a diode current-voltage characteristic in order to limit or clip an input signal to positive and/or negative amplitudes based on the control signals, or otherwise selected to provide spectral filtering or delay.

The example nonlinear signal transmission line signal processors illustrated above include alternating series inductors and/or voltage variable shunt capacitive/resistive sections. The element values of these inductors or shunt capacitive/resistive sections can be selected based on a Bragg cutoff frequency, impedance, or dispersion.

In the illustrated examples, transmission lines or waveguides extend along or are symmetrical with respect to a linear axis. In other examples, a transmission line or waveguide axis can be curved or include line segments or be otherwise configured.

Representative methods and apparatus are described above. It will be apparent that these methods and apparatus can be altered in arrangement and detail. For example, methods and apparatus can be configured for application to analog signals and/or digital signals, and alternative waveguide structures can be configured as nonlinear processors. Various types of filters and clippers/limiters can be provided such as low pass filters, high pass filters, and bandpass filters. We claim all that is encompassed by the appended claims.

We claim:

1. A voltage controlled signal processor, comprising:

a processing waveguide section that includes a processing waveguide, a first plurality of diodes and a second plurality of diodes distributed along an axis of the processing waveguide, the first plurality of diodes and the second plurality of diodes electrically coupled to the processing waveguide;

a first reference conductor and a second reference conductor; and a first control conductor and a second control conductor situated along the axis of the processing waveguide section and coupled to the processing waveguide by the first plurality of diodes and the second plurality of diodes, respectively, wherein the first and second reference conductors are capacitively coupled to the first and second control conductors, respectively.

2. The transmission line signal processor of claim 1, wherein the first plurality of diodes and the second plurality of diodes are configured to provide an operating characteristic selected from a group consisting of a diode current-voltage characteristic, a capacitance-voltage characteristic, and a voltage-phase characteristic.

3. The voltage controlled signal processor of claim 1, wherein each of the diodes of the first plurality of diodes is situated along the axis of the processing waveguide section and is associated with a corresponding diode of the second plurality of diodes.

4. The voltage controlled signal processor of claim 1, further comprising a controller configured to provide control signals to the first and second control conductors so that the diodes of the first plurality of diodes are forward biased and diodes of the second plurality of diodes are reverse biased.

5. The voltage controlled signal processor of claim 4, further comprising a controller configured to provide control signals to the first and second control conductors so that the diodes of the first and second pluralities of diodes are forward biased.

6. The voltage controlled signal processor of claim 1, further comprising a controller configured to provide control signals to the first and second control conductors so that the diodes of the first and second pluralities of diodes are reverse biased.

7. A communication system, comprising:

a data transmitter that produces a data signal;

a voltage controlled signal processor as recited in claim 1 that is configured to receive and process the data signal based on a tuning signal applied to the first and second control conductors; and a receiver configured to receive the processed data signal.

8. A voltage controlled signal processor, comprising:

a processing waveguide section that includes a processing waveguide, a first plurality of varactors and a second plurality of varactors distributed along an axis of the processing waveguide, the first plurality of varactors and the second plurality of varactors electrically coupled to the processing waveguide;

a first reference conductor and a second reference conductor; and a first control conductor and a second control conductor situated along the axis of the processing waveguide section and coupled to the processing waveguide by the first plurality of varactors and the second plurality of varactors, respectively, wherein the first and second reference conductors are capacitively coupled to the first and second control conductors, respectively.

9. The voltage controlled signal processor of claim 8, wherein each of the varactors of the first plurality of varactors is situated along the axis of the processing waveguide section and is associated with a corresponding varactor of the second plurality of varactors.

10. The voltage controlled signal processor of claim 8, further comprising a controller configured to provide control signals to the first and second control conductors so that the varactors of the first plurality of varactors and the varactors of the second plurality of varactors exhibit a voltage controlled capacitance characteristic and a voltage controlled resistance characteristic, respectively.

11. The voltage controlled signal processor of claim 8, further comprising a controller configured to provide control signals to the first and second control conductors so that the varactors of the first and second pluralities of varactors exhibit a voltage controlled capacitance characteristic.

12. The voltage controlled signal processor of claim 8, further comprising a controller configured to provide control signals to the first and second control conductors so that the varactors of the first and second pluralities of varactors exhibit a voltage controlled resistance characteristic.

13. The transmission line signal processor of claim 8, wherein the first plurality of diodes and the second plurality of diodes are configured to provide an operating characteristic selected from a group consisting of a diode current-voltage characteristic, a capacitance-voltage characteristic, and a voltage-phase characteristic.

14. A voltage controlled signal processor, comprising:

a processing waveguide section that includes a processing waveguide, a first plurality of varactors and a second plurality of varactors distributed along an axis of the processing waveguide, the first plurality of varactors and the second plurality of varactors electrically coupled to the processing waveguide;

at least one reference conductor; and a first control conductor and a second control conductor situated along the axis of the processing waveguide section and coupled to the processing waveguide by the first plurality of varactors and the second plurality of varactors, respectively, wherein the at least one reference conductor is capacitively coupled to the first and second control conductors.

15. The voltage controlled signal processor of claim 14, wherein each of the varactors of the first plurality of varactors is situated along the axis of the processing waveguide section and is associated with a corresponding varactor of the second plurality of varactors.

16. The voltage controlled signal processor of claim 14, further comprising a controller configured to provide control signals to the first and second control conductors so that the varactors of the first plurality of varactors and the varactors of the second plurality of varactors exhibit a voltage controlled capacitance characteristic and a voltage controlled resistance characteristic, respectively.

17. The voltage controlled signal processor of claim 14, further comprising a controller configured to provide control signals to the first and second control conductors so that the varactors of the first and second pluralities of varactors exhibit a voltage controlled capacitance characteristic.

18. The voltage controlled signal processor of claim 14, further comprising a controller configured to provide control signals to the first and second control conductors so that the varactors of the first and second pluralities of varactors exhibit a voltage controlled resistance characteristic.

19. The voltage-controlled signal processor of claim 14, further comprising a controller configured to provide a control signal to the first and second control conductors so that the first and second pluralities of varactors provide a predetermined phase shift.

20. The voltage-controlled signal processor of claim 14, wherein the varactors are diodes.

21. The voltage-controlled signal processor of claim 14, further comprising a controller configured to select an operating characteristic for the diodes selected from a group consisting of a current-voltage characteristic, a voltage-capacitance characteristic, and a voltage-phase characteristic.

22. The transmission line signal processor of claim 14, wherein the first plurality of diodes and the second plurality of diodes are configured to provide an operating characteristic selected from a group consisting of a diode current-voltage characteristic, a capacitance-voltage characteristic, and a voltage-phase characteristic.

23. The transmission line signal processor of claim 14, wherein the first plurality of varactors and the second plurality of varactors are configured to exhibit a selected spectral characteristic.

24. A communication system, comprising:

a data transmitter that produces a data signal;

a voltage controlled signal processor as recited in claim 14 that is configured to receive and process the data signal based on a tuning signal applied to the first and second control conductors; and a receiver configured to receive the processed data signal.

25. A communication system, comprising:

a data transmitter that produces a data signal;

a voltage controlled signal processor as recited in claim 8 that is configured to receive and process the data signal based on a tuning signal applied to the first and second control conductors; and a receiver configured to receive the processed data signal.

* * * * *